US005517222A

United States Patent [19]

Sugiyama et al.

[11] Patent Number: 5,517,222

[45] Date of Patent: May 14, 1996

[54] INK JET RECORDING APPARATUS HAVING ROTARY DRUM WITH INK RECEPTOR

[75] Inventors: Hiroshi Sugiyama, Yokohama; Kousuke Yamamoto, Kawasaki; Yoshitaka Okamura, Zama; Jun Ashiwa, Yokohama, all of Japan

[73] Assignee: Canon Kabushiki Kaisha, Tokyo, Japan

[21] Appl. No.: 388,887

[22] Filed: Feb. 14, 1995

Related U.S. Application Data

[63] Continuation of Ser. No. 905,524, Jun. 29, 1992, abandoned.

[30] Foreign Application Priority Data

Jul. 1, 1991 [JP] Japan ..... 3-160431

[51] Int. Cl.[6] ..... B41J 2/165

[52] U.S. Cl. ..... 347/35; 347/22; 347/104; 347/36

[58] Field of Search ..... 346/138; 347/31, 347/104, 31, 22, 33, 35, 36

[56] References Cited

U.S. PATENT DOCUMENTS

| | | | |
|---|---|---|---|
| 4,207,578 | 6/1980 | Marinoff | 346/75 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,701,771 | 10/1987 | Ikeda | 346/140 R |
| 4,723,129 | 2/1988 | Endo et al. | 346/1.1 |
| 4,740,796 | 4/1988 | Endo et al. | 346/1.1 |
| 5,040,000 | 8/1991 | Yokoi | 346/140 R |

FOREIGN PATENT DOCUMENTS

| | | |
|---|---|---|
| 57-103850 | 6/1982 | Japan . |
| 58-104756 | 6/1983 | Japan . |
| 59-123670 | 7/1984 | Japan . |
| 59-138461 | 8/1984 | Japan . |
| 2048958 | 2/1990 | Japan . |
| 3039255 | 2/1991 | Japan . |

*Primary Examiner*—Valerie A. Lund

*Attorney, Agent, or Firm*—Fitzpatrick, Cella, Harper & Scinto

[57] ABSTRACT

An ink jet recording apparatus which has at least one ink jet recording head to perform recording on a recording medium held on a rotary drum by discharging liquid ink from discharging nozzles, comprises a receptor, arranged on the rotary drum at a position which does not overlap with a position at which a recording medium is placed, for receiving ink droplets discharged by the ink jet recording head not for recording.

9 Claims, 8 Drawing Sheets

INK JET RECORDING APPARATUS HAVING ROTARY DRUM WITH INK RECEPTOR

This application is a continuation of application Ser. No. 07/905,524 filed Jun. 29, 1992, now abandoned.

BACKGROUND OF THE INVENTION

1. Field of the Invention

The present invention relates to an ink jet recording apparatus adapted to discharge ink droplets to perform recording, and more particularly, to an ink jet recording apparatus of on-demand type which selectively discharges ink droplets. More specifically, the present invention is directed to an ink jet recording apparatus which performs recording on a recording medium held by a rotary drum.

2. Related Background Art

FIGS. 7 and 8 are perspective views showing background art of an ink jet recording apparatus.

FIG. 7 illustrates a background art example of a type which transports a recording medium in a planar state. The apparatus of FIG. 7 comprises a recording head 1 for discharging ink droplets to perform recording; a carriage 2 for supporting the recording head 1 which is movable in a direction perpendicular to a feeding direction of the recording medium; guide rails 3 for supporting and guiding the carriage 2; a motor 4 for driving the carriage 2; a pulley 5 directly coupled to the motor 4; a dependent pulley 6 arranged opposite to the pulley 5; a wire 7 wound around and stretched between the pulley 5 and the dependent pulley 6 in order to transmit a driving force generated by the motor 4 to the carriage 2; a recording medium 9 such as a sheet of paper; a sheet feeding motor 10 for transporting the recording medium 9; a cap 12 for protecting discharging nozzles of the recording head 1 on standby from being dried; a roller 55 for transporting the recording medium 9; an urging roller 56 for urging the recording medium 9 onto the roller 55 by an energizing means, not shown; and an empty discharge box 57 located between the cap 12 and the recording medium 9 for the recording head 1 to perform so-called empty discharging such as discharging of ink droplets for other purposes than recording and preparatory discharging. An arrow 13 indicates the moving direction of the carriage 2, and an arrow 14 the rotating direction of the roller 15.

When the apparatus as constructed above performs recording, the recording head 1 having the discharging nozzles thereof protected by the cap 12 is separated from the cap 12, supplied with a driving force generated by the motor 4 and transmitted through the wire 7 wound around the pulley 5 and the dependent pulley 6, scanned together with the carriage 2 toward the recording medium 9, moved by a predetermined length near the recording medium 9, and then returned in the reverse direction, i.e., toward the cap 12. In the meantime, the recording head 1 reciprocally moves in the direction indicated by the arrow 13 and discharges ink droplets on a predetermined position to perform recording.

The recording medium 9, in turn, is transported in the direction indicated by the arrow 14 by a predetermined length every time one scanning operation of the recording head 1 is completed by means of the sheet feeding motor 14 and the roller 15. These operations are repeated to perform recording. However, in relation to this recording, if a recording apparatus employs a so-called on-demand type recording head which selectively discharges ink from discharging nozzles thereof, a time interval until discharging ink may be so long, depending on images, that the viscosity of ink existing near the nozzles is increased which may hinder normal operation. For this reason, the empty discharge box 17 is provided to solve this problem by periodically discharging ink even in a non-recording period. The empty discharge box 17 is located typically between the cap 12 and the recording medium 9, that is, not on the recording medium 9 but in the vicinity thereof, such that empty discharging is performed when the recording head 1, by the scanning of the carriage 2, reaches in front of the empty discharge box 17. The cap 12 can be used as a substitute for this empty discharge box 17.

Next, description will be given of the background art of a recording apparatus of a type which winds a recording medium around a rotary drum, as shown in FIG. 8.

The apparatus of FIG. 8 comprises a recording head 1 for discharging ink droplets to perform recording; a carriage 2 for supporting and carrying the recording head 1; guide rails 3 for supporting and guiding the carriage 2; a motor 4 for driving the carriage 2; a pulley 5 directly coupled to the motor 4; a dependent pulley 6 arranged opposite to the pulley 5; a wire 7 wound around and stretched between the pulley 5 and the dependent pulley 6 in order to transmit a driving force generated by the motor 4 to the carriage 2; a recording medium 9 mainly consisting of a sheet of paper; a sheet feeding motor 10 for transporting the recording medium 9; a rotary drum 8 rotatably coupled to the sheet feeding motor 10 for supporting the recording medium 9; and a cap 12 for protecting discharging nozzles of the recording head 1 on standby from being drying. These constituents are the same as those shown in FIG. 7. An arrow 13 indicates the moving direction of the carriage 2, and an arrow 14 the rotating direction of the rotary drum 8, which are also similar to the arrows 13 and 14 in FIG. 7. When the apparatus shown in FIG. 8 performs recording, the recording head 1 having the discharging nozzles thereof protected by the cap 12 is separated from the cap 12, supplied with a driving force generated by the motor 4 and transmitted by the wire 7 wound around the pulley 5 and the dependent pulley 6, and scanned together with the carriage 2 toward the recording medium 9. The rotary drum 8 is rotated together with the recording medium 9 in the direction indicated by the arrow 14 at a predetermined peripheral velocity by the driving force of the motor 10, while the recording head 1 discharges ink droplets on a predetermined position to perform recording. The recording head 1, upon completing recording of one line, moves to the recording position of the next line together with the carriage 2 to perform recording on that line. These operations are repeated to perform recording of each line.

The above described background art, however, implies the following problems to be solved.

The background art shown in FIG. 7 may comprise four to seven recording heads 1 respectively for discharging different color ink which are aligned to perform color recording. Such color recording can be performed only in one of going and returning movements of the carriage 2. This is because a color tone is changed from line to line due to the order of color deposition if changing in the going and returning processes.

Thus, an operation time required for the non-recording going or returning movement is useless, which results in delaying a recording time. However, if a moving speed of the recording head during non-recording is increased, an electric power consumption and noise are increased, and a larger motor must be employed as a result.

The background art shown in FIG. 9 does not imply so many problems as described above since recording cannot be performed only at a position where the recording medium wound around the rotary drum does not exist, that is, for a relatively short period in which the recording head cartridge 40 is not opposed to the recording medium. Nevertheless, in this background art, since the cap 46 is the only place to which the recording head cartridge 40 can discharge ink not for printing purpose during a printing operation, the on-demand type recording head adapted to selectively discharge ink droplets may suffer from defective discharging due to the aforementioned increase in viscosity of ink or the like. Particularly, for obtaining smaller ink droplets ranging approximately from 5 to 15 pl (pico liter) in order to record a high quality image, in contrast with ordinary ink droplets ranging approximately from 30 to 60 pl for recording an image in a pixel density of 400 dots/inch, the dimension of a discharging orifice of the recording head 1 and a discharging energy tend to be smaller, whereby the above-mentioned problem due to the increase in viscosity of ink becomes more serious.

SUMMARY OF THE INVENTION

It is an object of the present invention to provide an ink jet recording apparatus which is capable of performing empty discharging so as not to cause troublesome discharging due to increase in viscosity of ink even with a recording head having a minimum discharging nozzle dimension without dropping the recording speed.

The ink jet recording apparatus according to the present invention has a receptor, arranged at a position on a rotary drum on which a recording medium is not wound, for receiving ink droplets discharged from an ink jet recording head not for printing purpose.

The ink jet recording apparatus may also have means, arranged such that it can be contacted with the receptor, to remove at least part of ink attached on the receptor, and means for heating the receptor to evaporate at least part of solvent contained in ink attached on the receptor.

In the thus constructed ink jet recording apparatus of the present invention, by virture of the ink receptor provided to allow the recording head to periodically discharge ink not for recording purpose, it is possible to provide a recording apparatus which can employ a small ink droplet discharging head, which is relatively easily damaged by dried ink, and reduces useless recording time.

DETAILED DESCRIPTION OF THE PREFERRED EMBODIMENTS

Embodiments of the present invention will next be described with reference to the accompanying drawings.

EMBODIMENT 1

Figure 1:
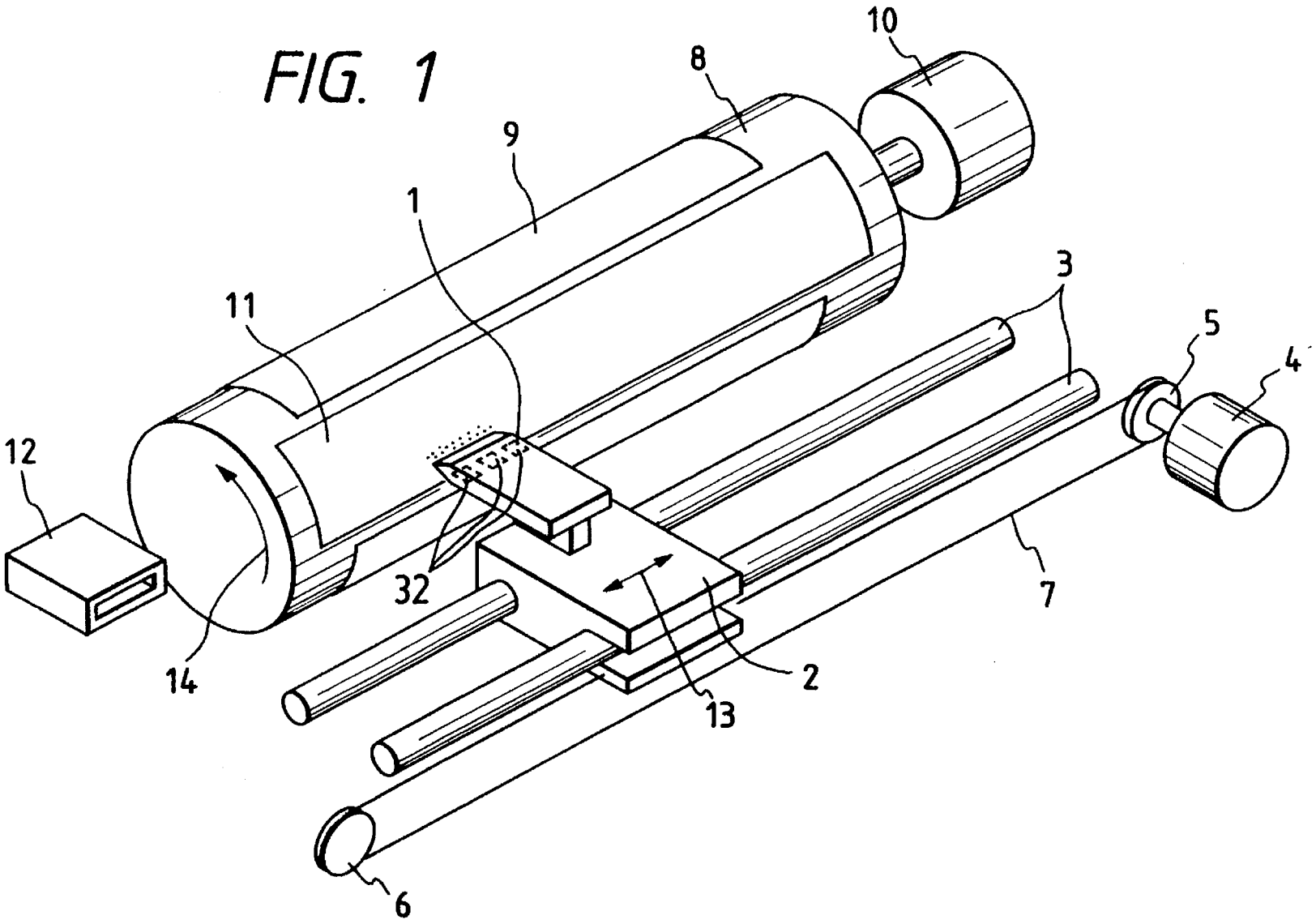
FIG. 1 is a perspective view of an ink jet recording apparatus according to a first embodiment of the present invention.

FIG. 1 is a schematic perspective view showing a main portion of an ink jet recording apparatus according to a first embodiment of the present invention;

This ink jet recording apparatus comprises a recording head 1 for discharging ink droplets to perform recording; a carriage 2 for supporting and carrying the recording head 1; guide rails 3 for supporting and guiding the carriage 2; a motor 4 for driving the carriage 2; a pulley 5 coupled to the motor 4; a dependent pulley 6 arranged opposite to the pulley 5; a wire 7 wound around and stretched between the pulley 5 and the dependent pulley 6 in order to transmit a driving force generated by the motor 4 to the carriage 2; a sheet feeding motor 10 for transporting a recording medium 9 mainly such as a sheet of paper or an overhead projector transparency; a rotary drum 8 rotatably coupled to the sheet feeding motor 10 for supporting the recording medium 9; and a cap 12 for protecting discharging nozzles of the recording head 1 on standby from being dried. An arrow 13 indicates the moving direction of the carriage 2, and an arrow 14 the rotating direction of the rotary drum 8. A receptor 11 is provided with a porous member capable of receiving ink droplets discharged from the recording head 1 and absorbing the ink. The length of the receptor 11 in the direction parallel to the axis of the rotary drum 8 is substantially equal to that of the recording medium 9.

Next, the operation of the ink jet recording apparatus will be described.

When the apparatus shown in FIG. 1 performs recording, the recording head 1 having the discharging nozzles thereof protected by the cap 12 is separated from the cap 12, supplied with a driving force of the motor 4 transmitted by the wire 7 wound around the pulley 5 and the dependent pulley 6, and transported together with the carriage 2 on the guide rails 3 to a position opposite to a designated position on the recording medium 9. The rotary drum 8 is rotated together with the recording medium 9 in the direction indicated by the arrow 14 at a predetermined peripheral velocity by the driving force of the motor 10, while the recording head 1 discharges ink droplets on a predetermined position to thereby perform recording on the recording medium 9. The recording head 1, upon completing recording of one line, moves to the recording position of the next line together with the carriage 2 to perform recording on that line. These operations are repeated to perform recording.

As shown in FIG. 1, the ink jet recording apparatus of the present embodiment is provided with the receptor 11 in the rotary drum 8 for holding the recording medium 9 for receiving ink in an empty discharging operation. This receptor 11 may be arranged at such a position that the empty discharging operation can be performed when recording on the recording medium 9 is suspended for a certain period during the operation of the recording apparatus. Therefore, the length of the receptor 11 need not necessarily correspond to the width of the recording medium 9. However, if the receptor 11 is arranged to have a length corresponding to the width of the recording medium 9, empty discharging can be performed at any position, whereby the recording head does not have to be scanned to a predetermined position every time empty discharging is to be performed, with the result that a recording time as a whole can be reduced. Preferably, the receptor 11 has a length a bit wider than the width (the longitudinal length of the rotary drum) of the recording medium 9 from the viewpoint of protection of ink splash and easiness of performing empty discharging from all nozzles.

With the above-mentioned construction, even if a time interval until discharging ink is considerably long, ink droplets can be discharged to the receptor 11 by rotating the rotary drum 8 to bring the receptor 11 opposite to the recording head 1 or in conformity with the rotation of the rotary drum 8, particularly when an on-demand type recording head which selectively discharges ink droplets is employed. Thus, since the ink existing near the discharging nozzles can be periodically released before an increase in viscosity of the ink reaches a critical point, recording is enabled without trouble in a short time even with a small liquid discharging recording head which is susceptible to increase in viscosity of ink due to evaporation of a solvent in the ink.

EMBODIMENT 2

Figure 2:
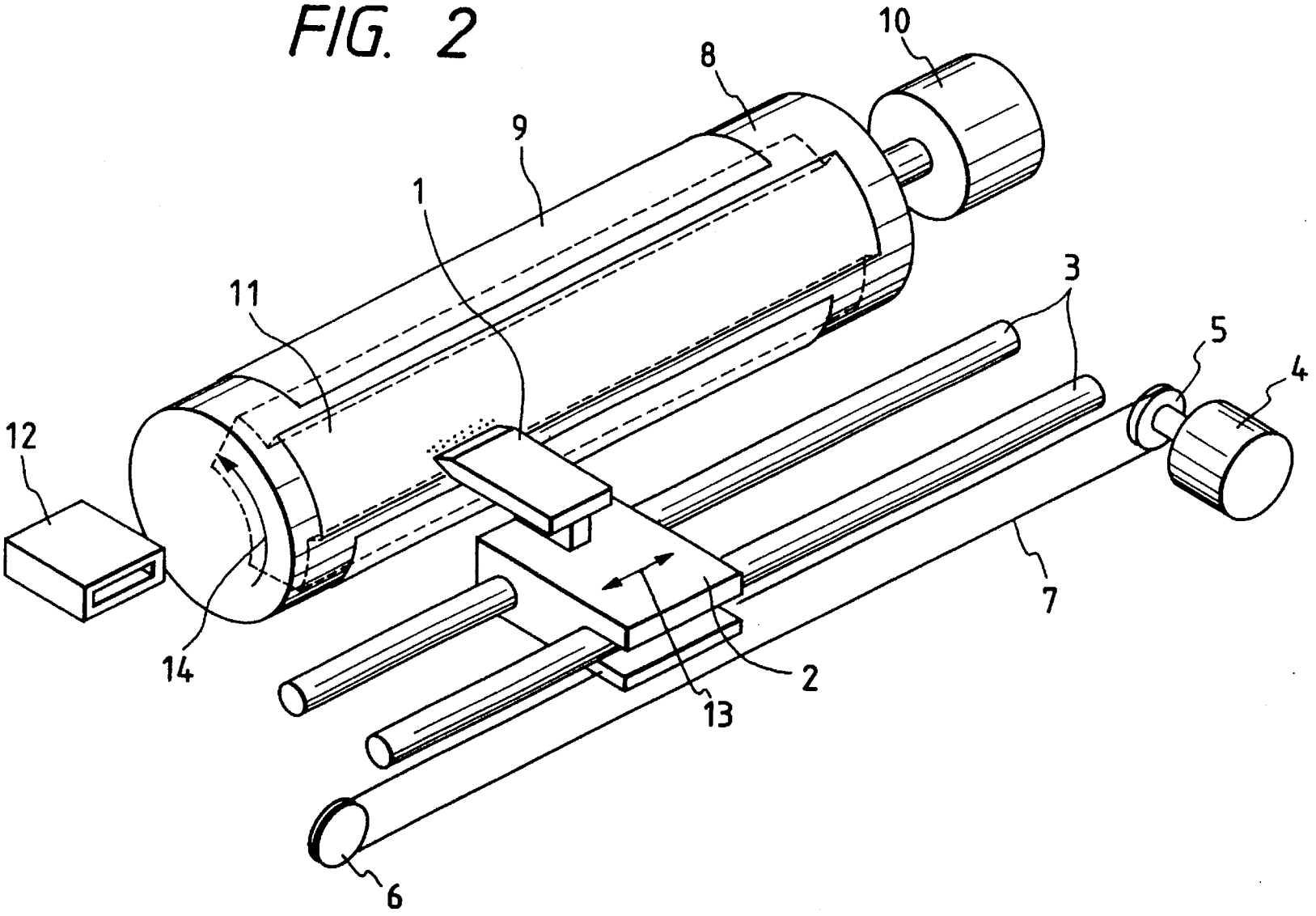
FIG. 2 is a perspective view of an ink jet recording apparatus according to a second embodiment of the present invention.

FIG. 2 is a perspective view showing a main portion of an ink jet recording apparatus according to a second embodiment of the present invention.

A receptor 11 of this ink jet recording apparatus has an increased ink receiving volume as compared with that of the receptor 11 shown in FIG. 1. This receptor 11 is provided with an extended ink absorbing member arranged up to the interior of a rotary drum 8 such that a large number of sheets can be successively recorded without leakage of ink from the receptor 11. The remaining construction is the same as that of the first embodiment so that explanation thereof will be omitted.

Incidentally, although not described in these embodiments, if the position of the ink receptor 11 on the rotary drum 8 must be precisely detected, the rotary drum 8 may be provided with a disk with a slit corresponding to that position, and the recording apparatus may be equipped with a sensor or a switch corresponding to the disk.

EMBODIMENT 3

Figure 3:
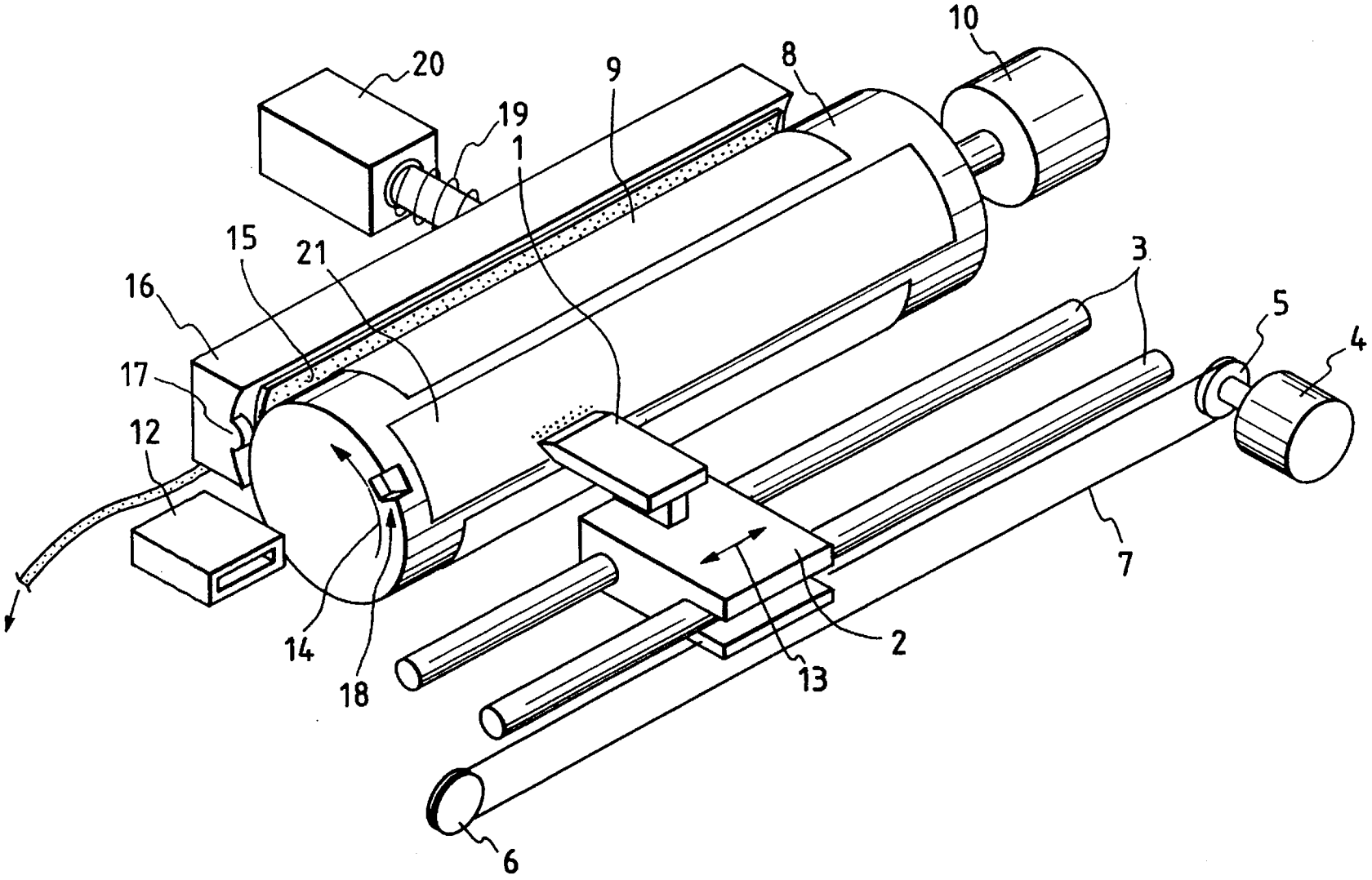
FIG. 3 is a perspective view of an ink jet recording apparatus according to a third embodiment of the present invention.
Figure 4:
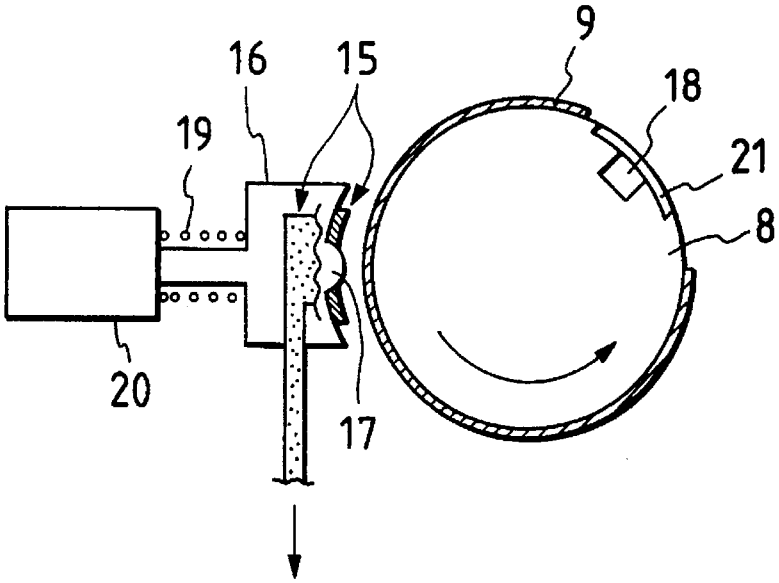
FIG. 4 is a diagram illustrating that a receptor 21 and an absorbing member 15 shown in FIG. 3 are not contacted with each other.
Figure 5:
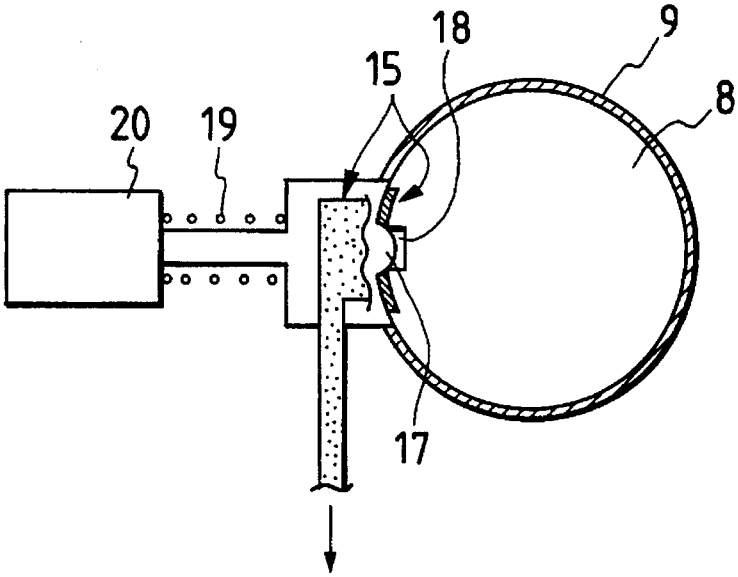
FIG. 5 is a diagram illustrating that the receptor 21 and the absorbing member 15 shown in FIG. 3 are contacted with each other.

FIG. 3 is a perspective view showing a main portion of an ink jet recording apparatus according to a third embodiment of the present invention; and FIGS. 4 and 5 are diagrams illustrating a normal state and an engaged state of a hook 17 and a notch 18 shown in FIG. 3.

This ink jet recording apparatus comprises a recording head 1 for discharging ink droplets to perform recording; a carriage 2 for supporting and carrying the recording head 1; guide rails 3 for supporting and guiding the carriage 2; a motor 4 for driving the carriage 2; a pulley 5 coupled to the motor 4; a dependent pulley 6 arranged opposite to the pulley 5; a wire 7 wound around and stretched between the pulley 5 and the dependent pulley 6 in order to transmit a driving power generated by the motor 4 to the carriage 2; a sheet feeding motor 10 for transporting a recording medium 9 mainly consisting of a sheet of paper; a rotary drum 8 rotatably coupled to the sheet feeding motor 10 for supporting the recording medium 9; and a cap 12 for projecting discharging nozzles of the recording head 1 on standby from being dried. An arrow 13 indicates the moving direction of the carriage 2, and an arrow 14 the rotating direction of the rotary drum 8. A receptor 21 is provided with a porous member capable of receiving ink droplets discharged from the recording head 1 and absorbing such ink. The length of the receptor 21 in the direction parallel to the axis of the rotary drum 8 is substantially equal to that of the recording medium 9. An absorbing member 15 is made of a porous material capable of absorbing ink, part of which is introduced to a wasted ink tank, not shown, for storing unnecessary ink.

In addition, this ink jet recording apparatus further comprises a holder 16 for holding the absorbing member 15; a hook 17 protruded from part of the holder 16; a notch engageable with the hook 17; a spring 19 for urging the holder 16 together with the absorbing member 15 toward the rotary drum 8; and a solenoid 20 for moving the holder 16 in the direction opposite to the urging direction of the spring 19.

Next, the operation of this ink jet recording apparatus will be described.

When this apparatus performs recording, the recording head 1 having the discharging nozzles thereof protected by the cap 12 is separated from the cap 12, supplied with a driving force of the motor 4 transmitted by the wire 7 wound around the pulley 5 and the dependent pulley 6, and transported together with the carriage 2 on the guide rails 3 to a position opposite to a designated position on the recording medium 9. The solenoid 20 is conducted to separate the holder 16 together with the absorbing member 15 from the rotary drum 8. The rotary drum 8 is rotated together with the recording medium 9 in the direction indicated by the arrow 14 at a predetermined peripheral velocity by the driving force of the motor 10, while the recording head 1 discharges ink droplets on a predetermined position of the recording medium 9. The recording head 1, upon completing recording of one line, moves to the recording position of the next line together with the carriage 2 to perform recording on that line. These operations are repeated to perform recording.

With the above-mentioned construction, even if a time interval until discharging ink is considerably long, ink droplets can be discharged to the receptor 21 so that ink existing near the discharging nozzles can be periodically discharged before an increase in viscosity of the ink reaches a critical point, whereby recording is enabled without trouble even with a small liquid discharging recording head which is susceptible to such increase in viscosity of the ink due to evaporation of a solvent contained in the ink.

When conduction to the solenoid 20 is stopped to remove ink attached on the receptor 21, the absorbing member 15 together with the holder 16 is urged toward the rotary drum 8 by the force of the spring 19. FIGS. 4 and 5 illustrates the operating states of these constituents. Specifically, FIG. 4 illustrates a state in which the receptor 21 is not contacted with the absorbing member 15, and FIG. 5 a state in which they are in contact with each other. The rotary drum 8, at this time, is ensured to stop at a position at which the notch 18 arranged at an end portion thereof is engaged with the hook 17, where the receptor 21 is contacted with the absorbing member 15 so that unnecessary ink can be introduced into the wasted ink tank.

EMBODIMENT 4

Figure 6:
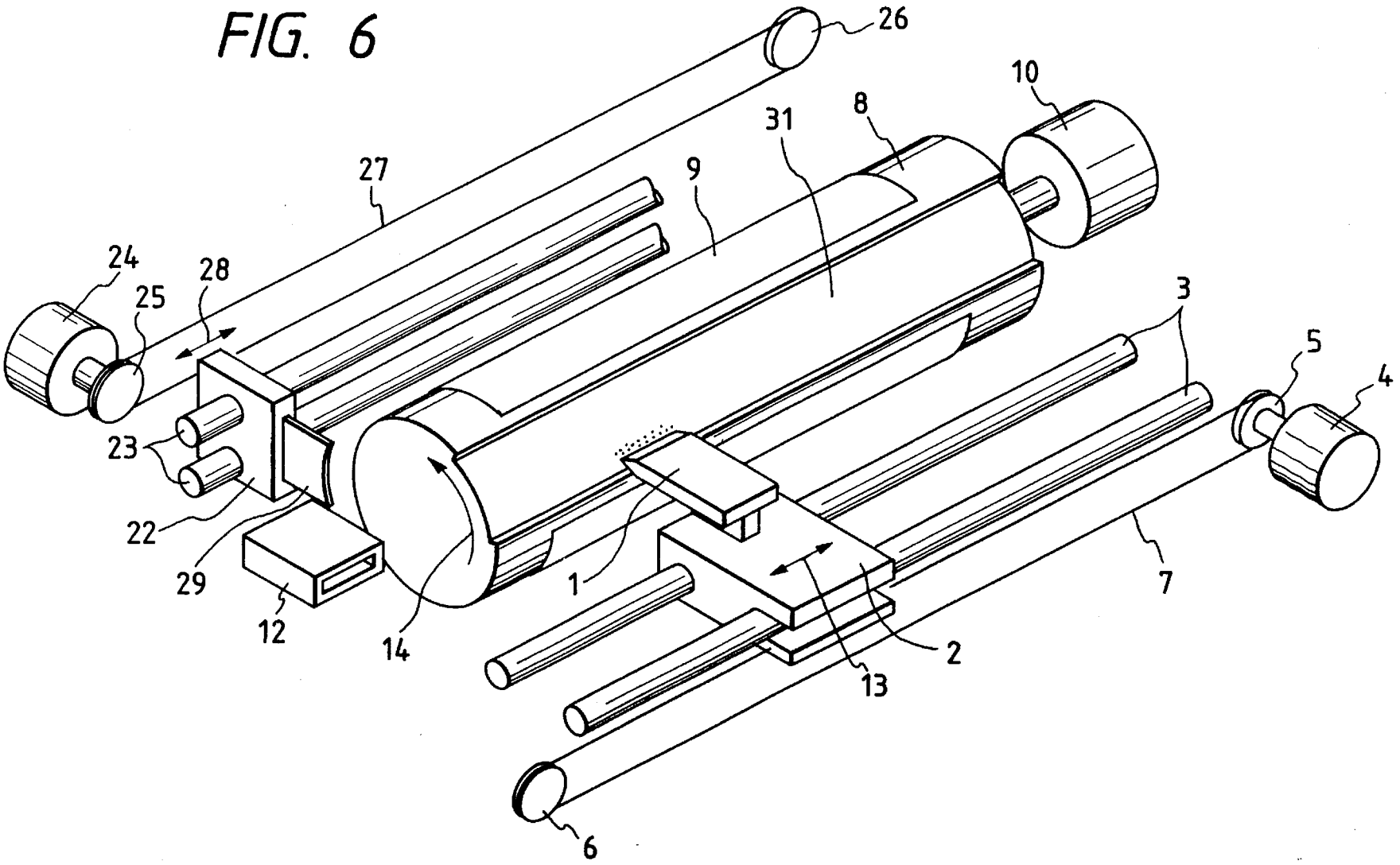
FIG. 6 is a perspective view of an ink jet recording apparatus according to a fourth embodiment of the present invention.
Figure 7:
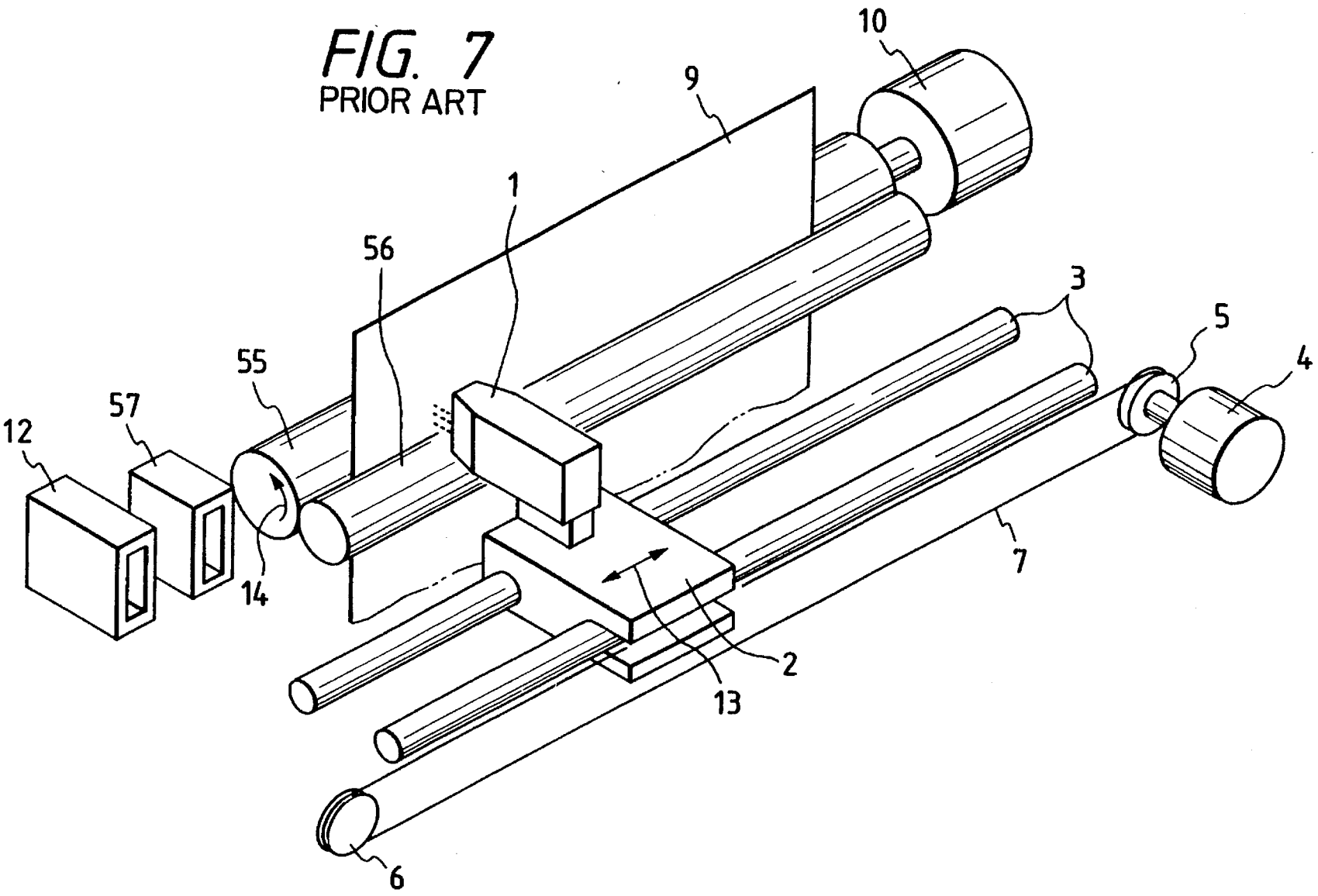
FIG. 7 PRIOR ART
FIG. 7 is a schematic perspective view showing an ink jet recording apparatus of a type which transports a recording medium in a plane state.
Figure 8:
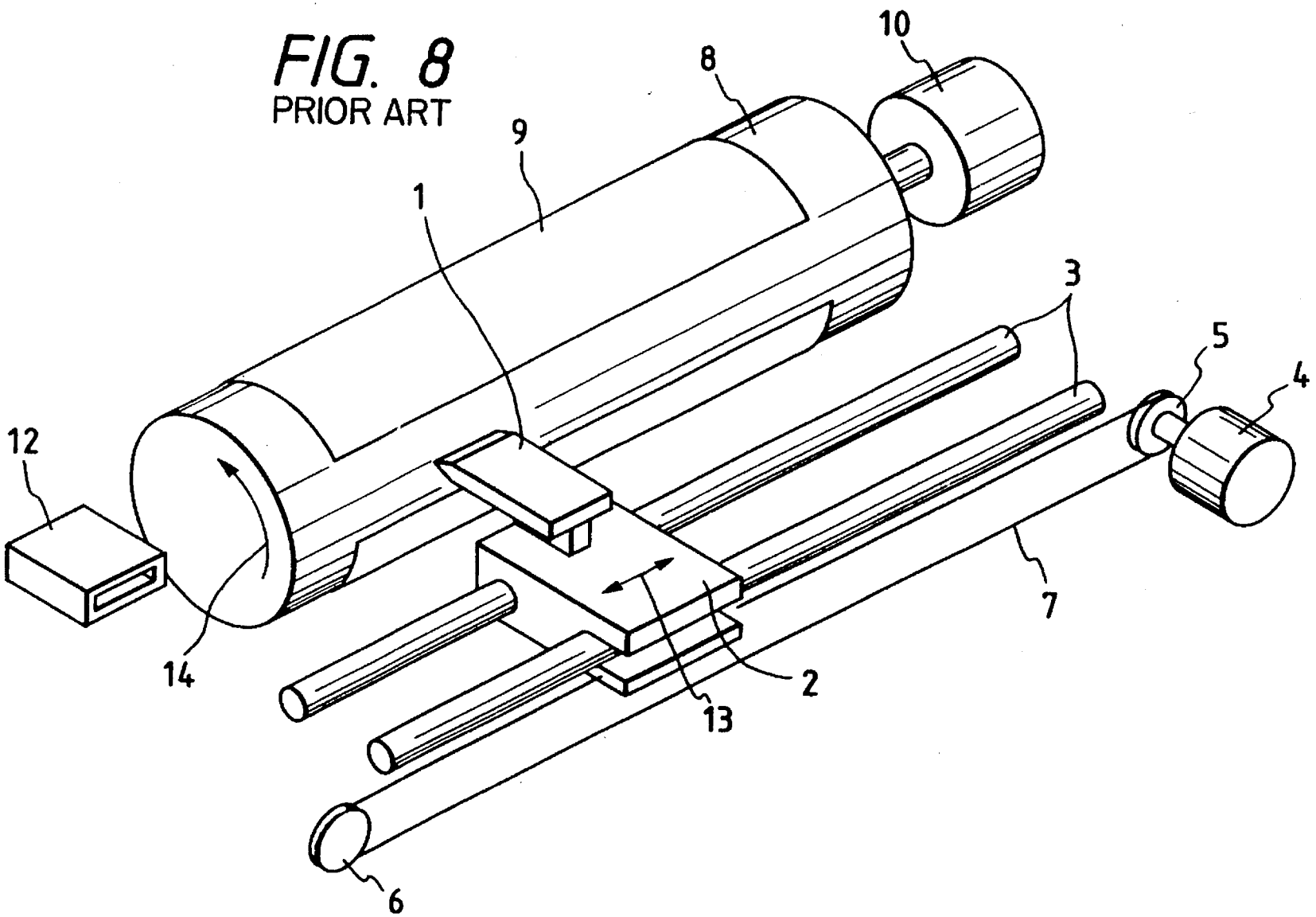
FIG. 8 PRIOR ART
FIG. 8 is a schematic perspective view showing an ink jet recording apparatus of a type which winds a recording medium around a rotary drum.

FIG. 6 is a perspective view showing a main portion of an ink jet recording apparatus according to a fourth embodiment of the present invention.

This ink jet recording apparatus comprises, in addition to the construction shown in FIG. 1, a blade 29 made of rubber or the like arranged at a position at which the blade 29 can be contacted with a receptor 31; a carriage 22 for the blade 29; a guiding shaft 23 for supporting and guiding the carriage 22; a motor 24 for driving the blade 29 together with the carriage 22; a pulley 25 coupled to the motor 24; a dependent pulley 26 arranged opposite to the pulley 25; and a wire 27 wound around and stretched between the pulley 25 and the dependent pulley 26. An arrow 28 indicates a moving direction of the carriage 22.

Next, description will be given of the operation for removing unnecessary ink attached on the receptor 31 after the apparatus has completed a recording operation.

The rotary drum 8 is rotated to a predetermined position and stopped at a position where the receptor 31 can be contacted with the blade 29. The blade 29 is reciprocated together with the carriage 22, as indicated by the arrow 28 by a driving force of the motor 24 transmitted thereto through the wire 27 wound around the pulley 25 and the dependent pulley 26 to remove unnecessary ink on the receptor 31 to the outside of the rotary drum 8. If the interior of the recording apparatus can be contaminated by removed ink, an ink absorbing member may be placed at a position on which such removed ink may drop.

EMBODIMENT 5

Although the fourth embodiment employs the blade 29 made of rubber or the like as a means for removing unnecessary ink, an ink absorbing member in a rotatable roller form may be alternatively employed. In this case, unnecessary ink can be removed from the receptor 31 by moving this ink absorbing member while it is contacted with the receptor 31 on the rotary drum 8 and rotated therearound.

Incidentally, although not described in the foregoing first to fifth embodiments, if the position of the ink receptor 11, 21 or 31 on the rotary drum 8 must be precisely detected, the rotary drum 8 may be provided with a disk with a slit corresponding to that position, and the recording apparatus may be equipped with a sensor or a switch corresponding to the disk.

Among ink jet recording methods, the present invention is effective also in a recording apparatus employing a recording head of a type which has electro-thermal transducers (as described below) identified by reference numeral 32 in FIG. 1 and which utilizes thermal energy to form droplets with which recording is performed.

The typical structure and principle of this type of recording apparatus preferably employ the basic principles disclosed, for example, in U.S. Pat. Nos. 4,723,129 and 4,740,796. This recording system is applicable to either of so-called on-demand type and continuous type.

Explaining briefly this recording system, an electro-thermal transducer arranged corresponding to a sheet and a liquid pathway, in which ink is held, is applied with at least one driving signal corresponding to recording information for giving a rapid temperature rise to ink to exceed nucleate boiling phenomenon and cause film boiling phenomenon, whereby thermal energy is generated to cause film boiling on a heat acting face of a recording head. Since bubbles which correspond one by one to the driving signal applied to the electro-thermal transducer can be formed by the ink, this recording system is particularly effective in an on-demand type recording apparatus. The ink is discharged from discharging orifices by the action of growth and contraction of bubbles to form at least one droplet. It is preferable that a pulse signal is used as the driving signal because the growth and contraction of bubbles are immediately and properly controlled by such a pulse-shaped driving signal so that an ink discharging mechanism, particularly excellent in a response characteristic, is achieved. As this pulse-shaped driving signal, those described in the specifications of U.S. Pat. Nos. 4,463,359 and 4,345,262 are suitable. Further, if conditions described in the specification of U.S. Pat. No. 4,313,124 concerning a temperature rising ratio on the heat acting face are employed, further excellent recording can be achieved.

The structure of the recording head may be such one that employs inventions described in the specifications of U.S. Pat. Nos. 4,558,333 and 4,459,600 which disclose a structure in which a heat acting portion is arranged in a bent region, in addition to a combined structure (a straight flow pathway or a perpendicular flow pathway) formed of discharging orifices, a liquid pathway and an electro-thermal transducer as disclosed in the above-mentioned respective specifications.

Additionally, the recording head may be constructed on the basis of Japanese Laid-Open Patent Application No. 59-123670 which discloses a structure where common slits serve as discharging orifices for a plurality of electro-thermal transducers and Japanese Laid-Open Patent Application No. 59-138461 which discloses a structure where an opening for absorbing pressure wave of thermal energy is arranged corresponding to a discharging section.

As a recording head which effectively utilizes the present invention, there is a recording head of full line type which has a length corresponding to the width of the widest recording medium on which a recording apparatus can record. This full line head may be constituted by either an assembly of a plurality of recording heads as disclosed in the foregoing specifications to extend over the full line length or a single integrated full line recording head.

The present invention is further effective in a recording apparatus which employs an exchangeable chip-type recording head to which electric connection with the recording apparatus and ink supply from the recording apparatus are enabled by mounting the head in the recording apparatus, or a cartridge type recording head which has an ink tank integrated therewith.

Also, addition of a recovering means for a recording head, a preparatory supporting means and so on, provided as constituents of the recording apparatus of the present invention, is preferable since the effect of the present invention can be further stabilized by these means. Specifically, these means may be a capping means; a cleaning means; a pressurizing or sucking means; a preparatory heating means comprising an electro-thermal transducer; and a heating element other than this or a combination of these two, all provided for the recording head. A preparatory discharging means for performing other discharging than that for recording purpose is also effective for performing stable recording.

Further, the present invention is extremely effective in a recording apparatus that has not only a main color recording mode, in which recording is performed only in a main color such as black, but also at least one of a plural color recording mode using different colors and a full color recording mode by mixing different colors, by the use of either an integral recording head or a combination of plural recording heads.

In the foregoing embodiments of the present invention, although ink was explained as a liquid, the ink may be such one that is solidified at temperatures less than room temperatures and softened or liquified at room temperatures. Alternatively, since the ink jet recording apparatus generally controls the temperature of ink in a range between 30° C. and 70° C. to maintain the viscosity of the ink in a stably dischargeable state, any ink may be used as long as it is in a liquid state when a recording signal is supplied.

Further, it is possible to employ ink which is solid in an unused state for the purpose of positively preventing an excessive temperature rise of a head or ink due to thermal energy by utilizing the thermal energy to change ink from a solid state to a liquid state, or for the purpose of preventing ink from evaporating. After all, the present invention is applicable to the use of ink having the characteristics of being liquified only by applying thermal energy thereto, e.g., ink which is liquified and discharged by applying thereto thermal energy in response to a recording signal; ink which has already begun to become solid when reaching a recording medium; and so on.

In the present invention, the most effective apparatus for the above-mentioned respective ink is one which executes the foregoing film boiling method.

Figure 9:
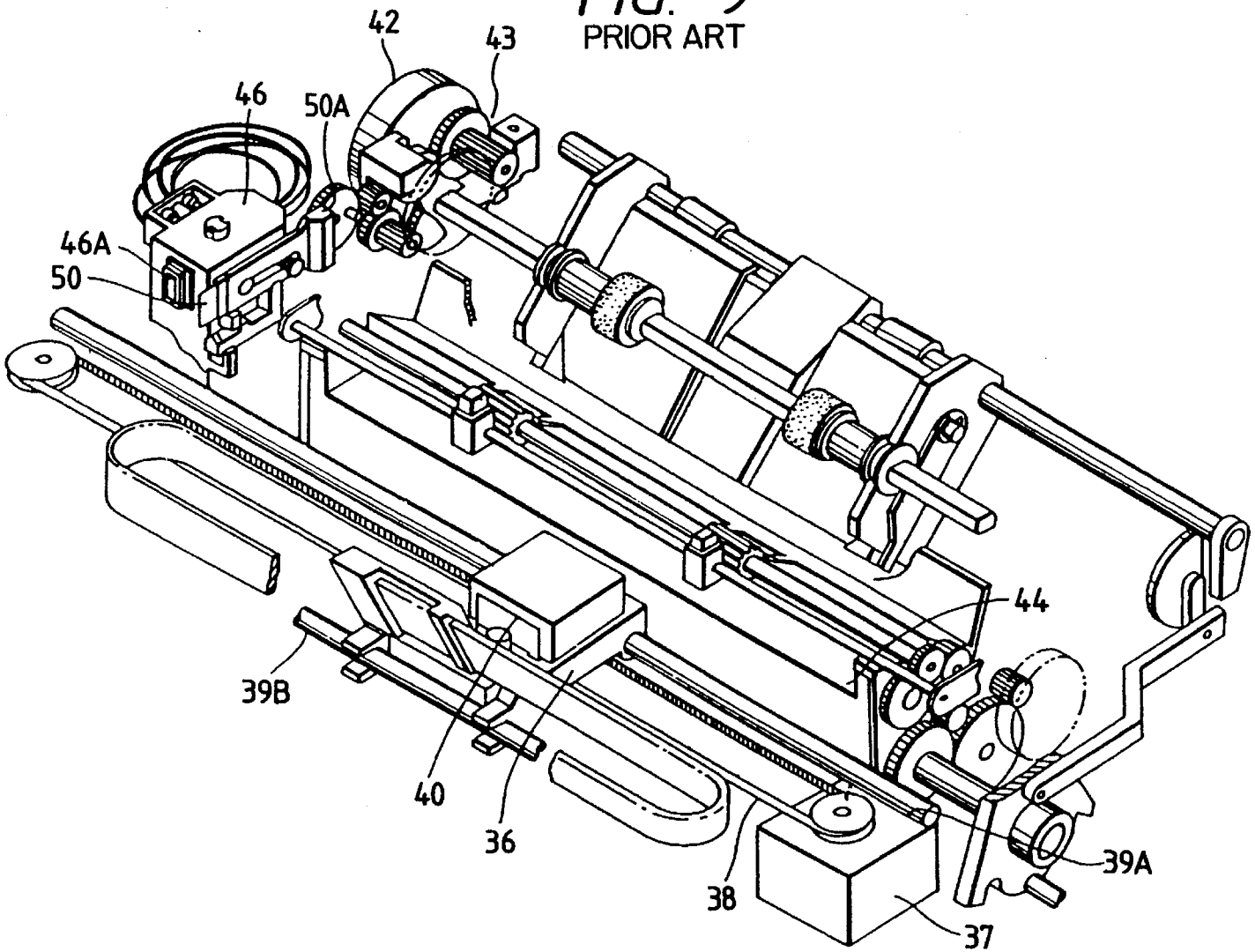
FIG. 9 PRIOR ART
FIG. 9 is a perspective view showing an example of an ink jet recording apparatus having a recording head of the present invention mounted therein as an ink jet head cartridge.

FIG. 9 is a perspective view showing the appearance of an exemplary ink jet recording apparatus (IJRA) in which the recording head provided by the present invention is mounted as an ink jet head cartridge (IJC).

In the drawing, an ink jet head cartridge (hereinafter referred to as "the IJC") 40 is provided with a group of nozzles for discharging ink onto a recording face of a recording medium fed on a platen 44. A carriage HC 36, which carries the IJC 40, is coupled to part of a driving belt 38 for transmitting a driving force of a driving motor 37 and is slidable on two guide shafts 39A and 39B arranged in parallel to each other, whereby the IJC 40 can reciprocally move over the whole width of the recording medium.

A head recovering device 46 is arranged at an end of a moving path of the IJC 40, for example, at a position opposite to a home position of the IJC 40. The head recovering device 46 is operated by a driving force of a motor 43 through a transmission mechanism 43 to cap the IJC 40. In relation to the capping of the IJC 40 by a cap 46A of the head recovering device 46, ink is sucked by an appropriate sucking means arranged in the head recovering device 46 or ink is delivered by a pressure developed by an appropriate pressurizing means arranged in an ink supply pathway to the IJC 40 to forcibly discharge ink through discharging orifices, whereby a discharging recovery operation is performed for removing ink in the nozzles, the viscosity of which is increasing. Upon completing recording, the IJC 40 is protected by capping same. A blade 50, arranged on a side face of the head recovering device 46, is a wiping member constituted of silicone rubber. The blade 50 and a related blade portion 50A are held by a blade holding member in a cantilever manner and operated by the motor 42 and the transmission mechanism 43, similarly to the head recovering device 46, such that the blade 50 can be engaged with the discharging face of the IJC 40. The blade 50 is thus projected in the moving pathway of the IJC 40, at an appropriate timing during a recording operation of the IJC 40 or after a discharging recovery operation by the use of the head recovering device 46, to wipe out condensed or leaked ink, dust and so on the discharging face of the IJC 40 with the movement of the IJC 40.

As described above, by providing an ink receptor on a rotary drum for holding a recording medium wound therearound to allow a recording head to periodically perform ink discharging not for recording, no trouble will arise in discharging even if an ink jet recording apparatus employs a small liquid discharging head, discharging nozzles of which are relatively susceptible to dried ink, and also a useless recording time is reduced.

By providing a removing means for removing unnecessary ink collected in the ink receptor, recording can be performed without trouble such as leakage of ink even when a large number of sheets are successively recorded.

What is claimed is:

1. An ink jet recording apparatus for use with at least one ink let recording head for performing recording by discharging ink from discharging nozzles onto a position on a rotary drum for holding a recording medium, said apparatus comprising:

a receptor, disposed on said rotary drum at a position which does not overlap with the position for holding the recording medium, for receiving ink discharged by said ink jet recording head; and removing means for contacting said receptor to remove at least a part of the ink received by said receptor, wherein said removing means includes an absorbing member.

2. An ink jet recording apparatus for use with at least one ink let recording head for performing recording by discharging ink from discharging nozzles onto a position on a rotary drum for holding a recording medium, said apparatus comprising:

a receptor, disposed on said rotary drum at a position which does not overlap with the position for holding the recording medium, for receiving ink discharged by said ink jet recording head; and removing means for contacting said receptor to remove at least a part of the ink received by said receptor, wherein said removing means includes a blade.

3. An ink jet recording apparatus according to claim 1 or 2, wherein said receptor comprises a porous member for absorbing ink.

4. An ink jet recording apparatus according to claim 1 or 2, further comprising an ink jet recording head having an ink discharging energy generating element which is an electrothermal transducer for generating thermal energy as discharging energy.

5. An ink jet recording apparatus according to claim 1 or 2, further comprising an engaging portion for engaging with said receptor and with said removing means to thereby position said receptor and said removing means.

6. A waste ink treatment apparatus for an ink jet recording apparatus, the ink jet recording apparatus having at least one ink jet recording head for performing recording by discharging ink from discharging nozzles onto a position on a rotary drum for holding a recording medium, said waste ink treatment apparatus comprising:

a receptor, disposed on said rotary drum at a position which does not overlap with the position for holding the recording medium, for receiving ink discharged by the ink jet recording head; and removing means for contacting said receptor to remove at least a part of the ink received by said receptor, wherein said removing means includes an absorbing member.

7. A waste ink treatment apparatus for an ink jet recording apparatus, the ink jet recording apparatus having at least one ink jet recording head for performing recording by discharging ink from discharging nozzles onto a position on a rotary drum for holding a recording medium, said waste ink treatment apparatus comprising:

a receptor, disposed on said rotary drum at a position which does not overlap with the position for holding the recording medium, for receiving ink discharged by the ink jet recording head; and removing means for contacting said receptor to remove at least a part of the ink received by said receptor, wherein said removing means includes a blade.

8. A waste ink treatment apparatus according to claim 6 or 7, wherein said receptor comprises a porous member for absorbing ink.

9. A waste ink treatment apparatus according to claim 6 or 7, further comprising an engaging portion for engaging with said receptor and with said removing means to thereby position said receptor and said removing means.

* * * * *

UNITED STATES PATENT AND TRADEMARK OFFICE

CERTIFICATE OF CORRECTION

PATENT NO. : 5,517,222

DATED : May 14, 1996

INVENTOR(S) : HIROSHI SUGIYAMA ET AL.

It is certified that error appears in the above-identified patent and that said Letters Patent is hereby corrected as shown below:

COLUMN 2

Line 28, "being" should be deleted.
Line 54, "ink" should read --inks--.

COLUMN 3

Line 5, "cap 46" should read --cap 46A--.
Line 40, "virture" should read --virtue--.

COLUMN 6

Line 58, "illustrates" should read --illustrate--.

COLUMN 10

Line 14, "let" should read --jet--.
Line 27, "let" should read --jet--.

Signed and Sealed this

Fifteenth Day of October, 1996

Bruce Lehman

*Attest:*

BRUCE LEHMAN

*Attesting Officer*

*Commissioner of Patents and Trademarks*